US010475357B2

(12) United States Patent
Kimes

(10) Patent No.: US 10,475,357 B2
(45) Date of Patent: Nov. 12, 2019

(54) BAGGAGE IDENTIFICATION TAGS AND METHODS OF MAKING AND USING THE SAME

(75) Inventor: Angela Kimes, Lake Dallas, TX (US)

(73) Assignee: R.R. Donnelley & Sons Company, Chicago, IL (US)

( * ) Notice: Subject to any disclaimer, the term of this patent is extended or adjusted under 35 U.S.C. 154(b) by 431 days.

(21) Appl. No.: 13/408,724

(22) Filed: Feb. 29, 2012

(65) Prior Publication Data

US 2013/0219759 A1 Aug. 29, 2013

(51) Int. Cl.

| | |
|---|---|
| ***G09F 3/00*** | (2006.01) |
| ***G09F 3/10*** | (2006.01) |
| ***B31D 1/02*** | (2006.01) |
| *G09F 3/02* | (2006.01) |

(52) U.S. Cl.

CPC ..... *G09F 3/0288* (2013.01); *B31D 1/021* (2013.01); *B31D 1/026* (2013.01); *B31D 1/027* (2013.01); *G09F 3/10* (2013.01); *G09F 2003/0254* (2013.01)

(58) Field of Classification Search

USPC ..... 40/6

See application file for complete search history.

(56) References Cited

U.S. PATENT DOCUMENTS

| | | | | |
|---|---|---|---|---|
| 3,228,129 | A * | 1/1966 | Dover et al. | 40/662 |
| 4,666,185 | A * | 5/1987 | Pilborough | 283/80 |
| 4,817,310 | A | 4/1989 | Breen et al. | |
| 4,916,841 | A * | 4/1990 | Dawson | 40/665 |
| 4,926,131 | A * | 5/1990 | Leydier | 327/126 |
| 5,279,057 | A * | 1/1994 | Melin et al. | 40/630 |
| 5,318,817 | A | 6/1994 | Ohno et al. | |
| 5,366,249 | A * | 11/1994 | Diemert | 283/80 |
| 5,395,667 | A | 3/1995 | Ohno et al. | |
| 5,670,225 | A * | 9/1997 | Yamanaka et al. | 428/40.1 |
| 5,707,082 | A * | 1/1998 | Murphy | 283/67 |
| 5,736,210 | A * | 4/1998 | Treleaven | 428/40.1 |

(Continued)

FOREIGN PATENT DOCUMENTS

ES 2031417 A6 12/1992

OTHER PUBLICATIONS

Canadian Intellectual Property Office, "Office Action," issued in connection with Canadian Patent Application No. 2,807,988, dated May 21, 2014, 2 pages.

(Continued)

*Primary Examiner* — Shin H Kim

(74) *Attorney, Agent, or Firm* — McCracken & Gillen LLC

(57) ABSTRACT

Baggage identification tags and methods of making and using the same are disclosed. An example method includes providing first and second lines of weakness extending only through the liner. A first portion of the liner between the first line of weakness and the first end forms a first liner backing of a claim check, a second portion of the liner is formed between the first line of weakness and the second line of weakness, a third portion of the liner between the second line of weakness and the second end forms a second liner backing of a baggage identification tag. The method includes providing instructions to remove the first portion of the liner by peeling the first portion of the liner from the first line of weakness in a first direction toward the first end and enabling the second portion of the liner to separate from the liner.

39 Claims, 5 Drawing Sheets

(56) References Cited

U.S. PATENT DOCUMENTS

| | | | | |
|---|---|---|---|---|
| 5,799,426 | A * | 9/1998 | Peterson | 40/633 |
| 5,871,829 | A * | 2/1999 | Nishizawa et al. | 428/40.1 |
| 6,303,201 | B1 * | 10/2001 | Baierl et al. | 428/40.1 |
| 7,579,059 | B2 * | 8/2009 | Chamandy | 428/40.1 |
| 7,752,794 | B2 * | 7/2010 | Kerlin | 40/633 |
| 8,167,336 | B2 * | 5/2012 | Minor et al. | 283/80 |
| 8,567,674 | B2 * | 10/2013 | Conaghan et al. | 235/384 |
| 2012/0258271 | A1 * | 10/2012 | Maughan | 428/40.1 |

OTHER PUBLICATIONS

Canadian Intellectual Property Office, "Notice of Allowance," issued in connection with Canadian Patent Application No. 2,807,988, dated Jul. 6, 2016, 1 page.

Canadian Intellectual Property Office, "Office Action," issued in connection with Canadian Patent Application No. 2,807,988, dated May 19, 2015, 3 pages.

* cited by examiner

BAGGAGE IDENTIFICATION TAGS AND METHODS OF MAKING AND USING THE SAME

FIELD OF THE DISCLOSURE

This disclosure relates generally to baggage identification tags, and, more particularly, to baggage identification tags and methods of making and using the same.

BACKGROUND

Baggage identification (ID) tags have been used in the airline industry to identify an owner of a bag and a destination city. Often, a passenger rushes to make a flight and/or a ticketing agent is pressured to quickly process each passenger to help passengers make their flights, ensure luggage is delivered to the correct flights, reduce wait times, etc. During such haste, the passenger or ticketing agent may quickly and/or inaccurately separate or remove a liner from a substrate that forms the baggage ID tag or label, which could tear the tag and/or expose too much adhesive. If too much adhesive is exposed, the tag may inadvertently become adhered to surfaces, including folding over upon itself in a manner that causes the tag to obscure bar codes or other identifying information that appears on a surface of the tag. If the tag is torn and/or the barcodes are obscured, the tag may no longer be machine- or human-readable. Further, any attempt by the passenger or ticketing agent to reattach or otherwise fix the tag may result in further damage to the tag often to the point that the tag is ruined entirely. Consequently, in addition to wasted material and costs associated therewith, the passenger and ticketing agent may have to take the time to reprint and attach an additional tag.

DETAILED DESCRIPTION

Figure 1:
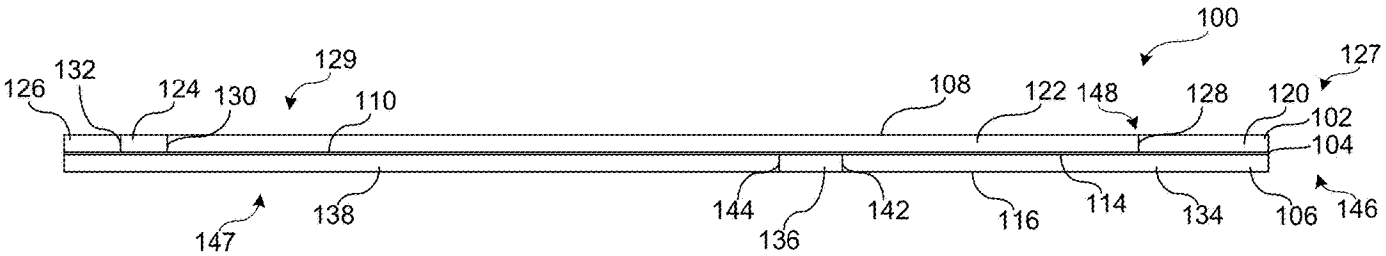
FIG. 1 is a cross-sectional view of an example baggage identification tag in accordance with the teachings of this disclosure.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness. Additionally, several examples have been described throughout this specification.

Any features from any example may be included with, a replacement for, or otherwise combined with other features from other examples.

The examples disclosed herein relate to baggage identification (ID) tags or labels that are easily useable by passengers and/or ticketing agents. Specifically, the examples disclosed herein relate to baggage ID tags or labels that ensure that passengers (e.g., airline passengers, train passengers, cruise ship passengers, etc.), ticketing agents and/or other people using the tags or labels do not inadvertently destroy the labels when attempting to remove a baggage claim check and/or couple the tag or label to baggage.

In some examples, the tag includes a substrate having a first side to which a liner is coupled and a second side that receives information such as, for example, machine- and/or human-readable information. The information identifies the owner of the bag and/or passenger associated with the bag, the destination of the bag and/or other information that may be used in routing the baggage to its final destination and/or for tracking the location of the baggage.

In some examples, the substrate includes first, second, third and fourth substrate portions. The first substrate portion forms the baggage claim check and is separated from the second substrate portion by a first line of weakness. The first line of weakness may be straight, curved and/or any other shape. The second substrate portion is separated from the third substrate portion by a second line of weakness, and the third substrate portion is separated from the fourth substrate portion by a third line of weakness. The second, third and/or fourth substrate portions form the baggage ID tag. The first, second and/or third lines of weakness may only extend through the substrate and, therefore, not through the liner. In some examples, the third substrate portion may be associated with a first leg of a trip, and the fourth substrate portion may be associated with a second leg of the trip. Thus, information relating to the different trip legs may be printed on the corresponding substrate portions. In addition, in some examples, the third and/or fourth portions form labels that are to be affixed to one or more exterior surfaces of the baggage and may bear machine-readable indicia for redundant processing during the baggage handling process. Such labels are redundant to the main baggage ID tag and increase the likelihood that the baggage label is readable by a machine and the baggage is properly identified during handling.

In some examples, the liner includes first, second and third liner portions. The second liner portion may separate the first liner portion from the third liner portion. The first liner portion may form a liner backing for a baggage claim check and the second and/or third liner portions may form a liner backing for a baggage ID tag. The first liner portion may be separated from the second liner portion by a fourth line of weakness and the second liner portion may be separated from the third liner portion by a fifth line of weakness. The fourth and fifth lines of weakness may be parallel to one another and may only extend through the liner and, therefore, not through the substrate. The fifth line of weakness may be between the fourth line of weakness and an end of the liner. Because of the fifth line of weakness, if a person removes the second liner portion from the substrate instead of the first liner portion, the second liner portion separates from the third liner portion and can be removed from the substrate without changing and/or damaging the third liner portion. Thus, if a passenger and/or ticking agent incorrectly attempts to use the tag, the tag will not be destroyed.

To assist a person in using and/or self-application of the tag, the first liner portion may include instructions to remove and/or peel the first liner portion at the line of weakness in a first direction away from the second liner portion. Additionally or alternatively, to assist a person in using the tag, the second and/or third liner portion(s) may include instructions not to separate the second and/or third liner portion(s) from the substrate.

In operation, the first liner portion is peeled from the second substrate portion and the fourth line of weakness toward a first end of the tag and/or the first substrate line weakness. After the first liner portion is peeled over the first substrate line of weakness, the first liner portion and the first substrate portion separate from the tag, the first substrate portion forming the baggage claim check and the first liner portion forming a liner backing of the baggage claim check. With the luggage claim check removed, an area of adhesive is exposed on the portion of the second substrate portion that was aligned with the first liner portion. The baggage ID tag (i.e., the second, third and fourth substrate portions and the second and/or third liner portions) may be fed through a handle of the baggage and the exposed adhesive of the second substrate portion may be aligned with and coupled and/or adhered to the third liner portion as the tag is folded back on itself. In some examples, the tag is fed through the handle before the baggage claim check is removed.

Figure 2:
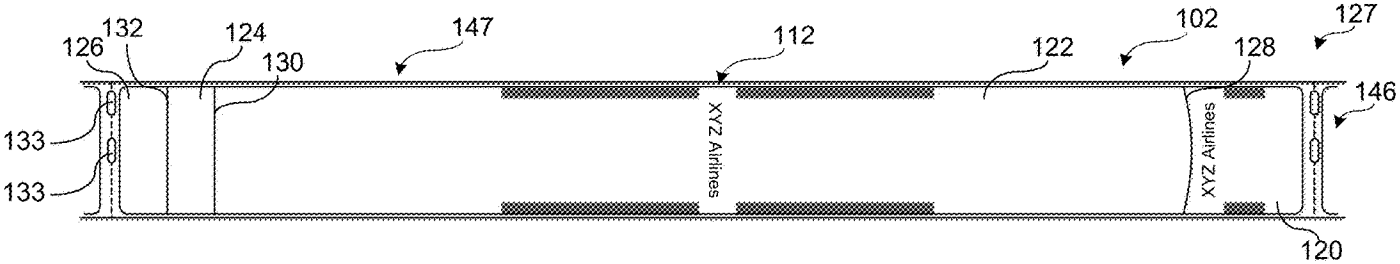
FIG. 2 is a plan view of a first side of the example baggage identification tag of FIG. 1.
Figure 3:
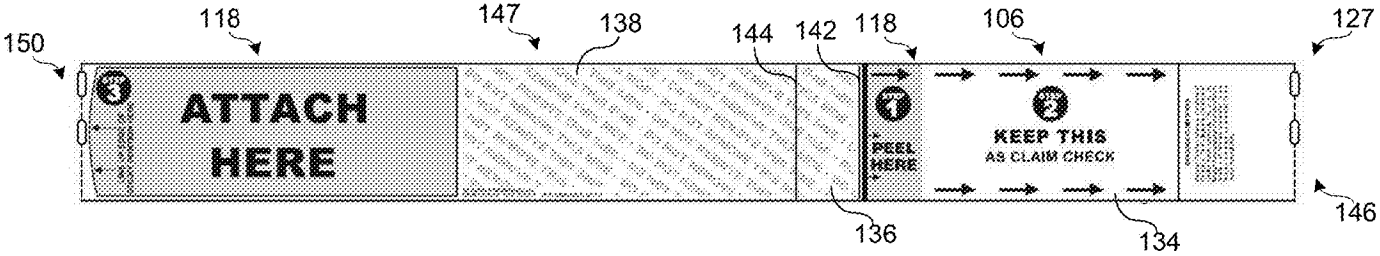
FIG. 3 is a plan view of a second side of the example baggage identification tag of FIG. 1.

FIGS. 1-3 depict different views of an example baggage ID tag or label 100. The tag 100 includes a first layer, label or substrate 102, a second layer or adhesive 104 and a third layer or liner 106. In this example, the adhesive 104, which may include permanent adhesive portion(s) and/or deadener portion(s), is positioned between the substrate 102 and the liner 106. The substrate 102 has a first substrate side 108 and a second substrate side 110. The first substrate side 108 may receive and/or include airline, trip and/or routing information (e.g., human- and/or machine-readable) 112 and/or passenger information and the second substrate side 110 is coupled to the adhesive 104. The liner 106 has a first liner side 114 and a second liner side 116. One or more portions of the first liner side 114 may be removably, repositionally and/or permanently coupled to the adhesive 104 over the substrate 102. The second liner side 116 may receive and/or include instructions 118 on how to use the tag 100, and/or any other suitable information and/or instructions.

In some examples, the substrate 102 includes first, second, third and fourth substrate portions 120, 122, 124, 126. The first substrate portion 120, which forms a baggage claim check 127, may be separated from the second substrate portion 122 by a first line of weakness 128. In this example, the first line of weakness 128 is curved though any shape may be used. The second substrate portion 122 is separated from the third substrate portion 124 by a second line of weakness 130 and the third substrate portion 124 is separated from the fourth substrate portion 126 by a third line of weakness 132. The second, third and/or fourth substrate portion(s) 122, 124, 126 form a baggage ID tag 129. In this example, the first, second and third lines of weakness 128, 130, 132 extend only through the substrate 102 and, therefore, not through the liner 106. In some examples, the third substrate portion 124 may receive information associated with a first leg of a trip, and the fourth substrate portion 126 may receive information associated with a second leg of a trip. Alternatively, the third and fourth substrate portions 124 and 126 provide routing information for the trip/destination and are to be adhered to different sides of the baggage. Also, in some examples, sensor holes 133 may extend through the tag 100. The sensor holes 133 are used to enable a printer to determine where the label ends.

In some examples, the liner 106 includes first, second and third liner portions 134, 136, 138. The first liner portion 134 forms a liner backing to the baggage claim check 127 and the second and/or third liner portion(s) 136, 138 form a liner backing to the baggage ID tag 129. The second liner portion 136 separates the first liner portion 134 from the third liner portion 138. The first liner portion 134 is separated from the second liner portion 136 by a fourth line of weakness 142, and the second liner portion 136 is separated from the third liner portion 138 by a fifth line of weakness 144. In this example, the fourth and fifth lines of weakness 142, 144 extend only through the liner 106 and, therefore, not through the substrate 102. If a person removes the second liner portion 136 from the substrate 102 instead of the first liner portion 134, the fifth line of weakness 144 causes the second liner portion 136 to separate from the substrate 102 without changing and/or damaging the third liner portion 138. In other words, the third liner portion 138 remains coupled to the substrate 102, and the tag remains intact.

In operation, the first liner portion 134 is peeled from the second substrate portion 122 at the fourth line of weakness 142 toward a first end 146 of the tag 100 and the first substrate line weakness 128. After the first liner portion 134 is peeled over the first substrate line of weakness 128, the first liner portion 134 and the first substrate portion 120 separate from the tag 100. The first substrate portion 120 forms the baggage claim check 127, and the first liner portion 134 forms a liner backing of the baggage claim check 127. A remaining portion 147 of the tag 100, which includes the baggage ID tag 129, may be fed through a handle of the baggage, and an end and/or edge 148 of the second substrate portion 122 may be aligned with and coupled to an end and/or edge 150 of the third liner portion 138 when the tag is looped around and/or folded upon itself.

Figure 4:
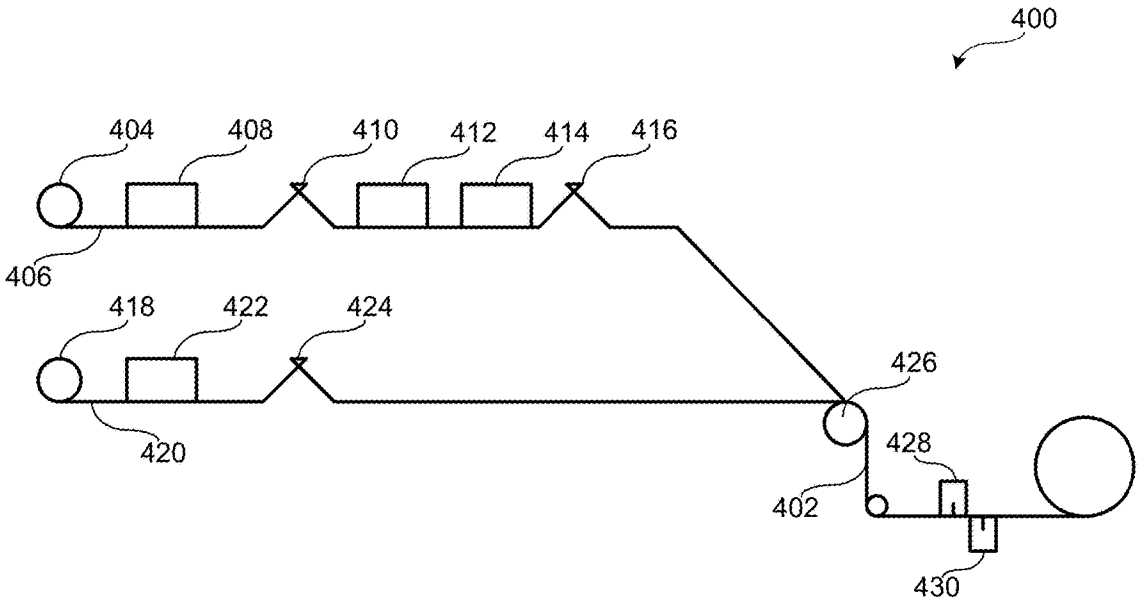
FIG. 4 depicts an example system that may be used to produce the examples disclosed herein.

FIG. 4 depicts an example system 400 for producing an example web 402 of baggage ID tags 100. The example system 400 includes a first unwinder 404 that unwinds a substrate layer or first ply 406. In some examples, a printer 408 prints information onto a first side of the substrate layer 406. The information may include an airline name or logo and/or any other suitable information. In other examples, the system 400 may not include the printer 408 and any printing may be done, for example, at the airport.

After the printer 408 prints on the first side of the substrate layer 406, the substrate layer 406 is optionally inverted at turn bar 410. For example, the substrate layer 406 may be inverted to enable an adhesive station 412 to apply an adhesive layer (e.g., a continuous layer or a pattern) to a second side of the substrate layer 406. The adhesive may be removable and/or repositionable adhesive, pressure sensitive adhesive and/or any other type of adhesive. In some examples, portions of the adhesive layer may be permanent adhesive. In some examples, adhesive may not be applied to the area where the second liner portion 136 is to be positioned. In such examples, the second liner portion 136 may remain coupled to the substrate layer 406 via the third liner portion 138 or, alternatively, the second liner portion 136 is removed to induce the ticketing agent or passenger to properly peel the first liner portion 134 in the direction toward the first end 146.

After the adhesive is applied to the substrate layer 406, the substrate layer 406 enters a varnishing station 414, which may be combined with the adhesive station 412 in some examples. At the varnishing station 414, a varnish or other deadening material is applied to one or more portions of the adhesive layer on the substrate layer 406 to deactivate or deaden the corresponding portion of the adhesive layer. In some examples, the varnish or deadening material (e.g., a silicon layer) is applied to one or more corners of a portion of the liner to facilitate grasping and removing of the liner. In some examples, the varnish or deadening material is not applied to where the second and/or third liner portion(s) 136, 138 are coupled to enable the second and/or third liner portion(s) 136, 138 to be permanently coupled to the substrate 102 to maintain the integrity of the tag. After the varnish is applied, the substrate layer 406 is optionally inverted at turn bar 416. For example, if the adhesive and varnish were applied to the second side of the substrate layer 406, the turn bar 416 may be needed to reorient the substrate layer 406 depending on the orientation of the other ply to which the substrate layer 406 is later married, as described below.

The example system 400 also includes a second unwinder 418 that unwinds a liner layer or second ply 420. In some examples, a printer 422 may print information onto a first side of the liner layer. The information may include instructions as to how to use the baggage ID tags including, for example, in one or more languages. In other examples, the system 400 may not include the printer 408 and printing (if any) may be done, for example at the airport. After the printer 422 prints on the second side of the liner layer 420, the liner layer 420 is optionally inverted at turn bar 424. For example, if the printer 422 prints on the second side of the liner layer 420, the turn bar 424 may be needed to reorient the liner layer 420 depending on the orientation of the other ply to which the substrate is later married, as described below.

After the substrate layer 406 and the liner layer 420 are treated (e.g., provided with a layer of adhesive, varnish, release coating and/or printing) and properly oriented, the substrate and liner layers 406, 420 are fed into a press 426 and married or otherwise coupled to form the example web 402. In some examples, first and second cutters 428, 430, which may be implemented as a single device, may die cut, perforate, slit or otherwise form line(s) of weakness in the web 402. The first cutter 428 cuts through one or more portions (e.g., the first-third lines of weakness) of the substrate layer 406 from a first or exposed face of the substrate layer 406. The second cutter 430 cuts through one or more portions (e.g., fourth and fifth lines of weakness) of the liner layer 420 from a second or exposed face of the liner layer 420. In addition, one of the cutters 428 and/or 430 or another cutter cuts through the entire web to form a line of weakness to separate a plurality of baggage ID tags. After the cuts are made, the web 402 is wound or folded for transportation, storage, etc.

Figure 5:
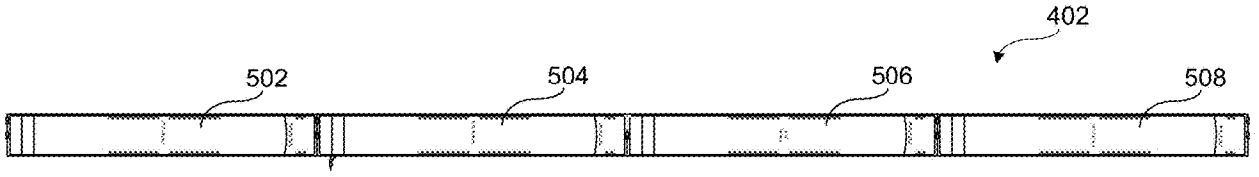
FIG. 5 is a plan view of a first side of a portion of an example web in accordance with the teachings of this disclosure.
Figure 6:
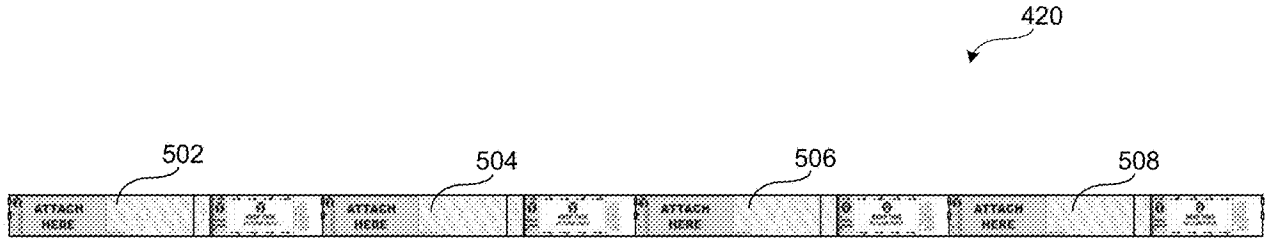
FIG. 6 is a plan view of a second side of the portion of the example web of FIG. 5.

FIGS. 5 and 6 depict portions of the web 402 including first through fourth baggage ID tags 502, 504, 506, 508 that can be produced using the example system 400. FIG. 5 depicts a first side of the web 402 corresponding to the substrate layer 406 and FIG. 6 depicts a second side of the web 402 corresponding to the liner layer 420.

Figure 7:
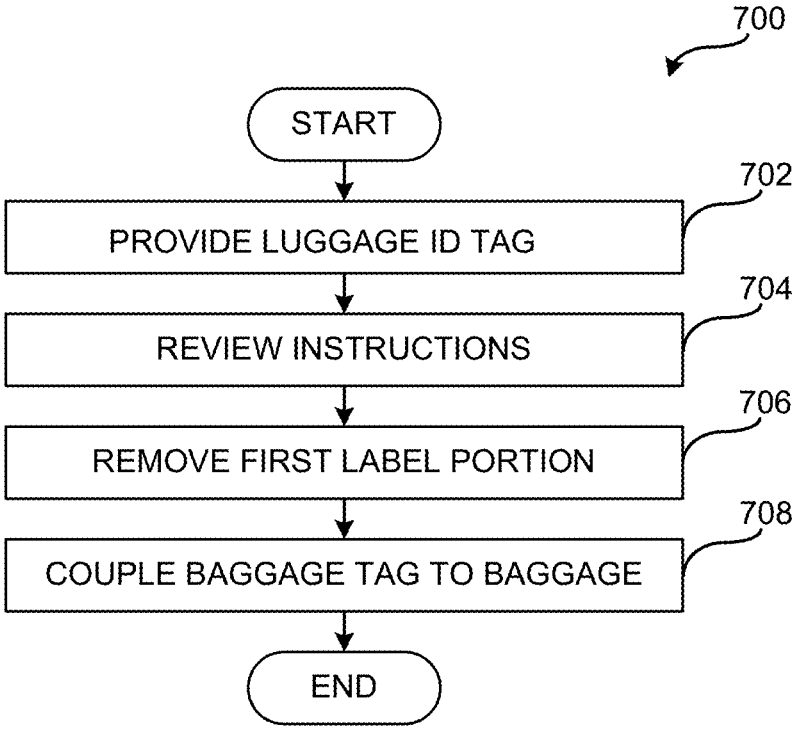
FIG. 7 is an example method of using the example baggage identification tags disclosed herein.

FIG. 7 is an example method 700 of using the examples disclosed herein. At block 702, a passenger or ticketing agent is provided with the example tag 100. The example tag 100 may include the substrate 102 and the liner 106 coupled to the substrate 102 by the adhesive 104. The liner 106 may include first, second and third liner portions 134, 136 and 138 that are separated by one or more lines of weakness 142, 144. In some examples, the first liner portion 134 has a greater length than the second liner portion 136. In some examples, the third liner portion 138 has a greater length than the first liner portion 134.

The substrate 102 may include first, second, third and fourth substrate portions 120, 122, 124 and 126 that are separated by one or more lines of weakness 128, 130 and 132. The first substrate portion 120 may form the baggage claim check 127 and the second, third and/or fourth substrate portions 122-126 may form the portion 147 of the tag 100 to be affixed to the baggage (i.e., the baggage ID tag).

At block 704, the passenger or ticketing agent may review the instructions 118 provided on the liner 106 and, at block 706, the passenger or ticketing agent may peel the first liner portion 134 from the second substrate portion 122 at the fourth line of weakness 142 toward the first end 146 of the tag 100 and/or the first substrate line weakness 128. After the first liner portion 134 is peeled over the first substrate line of weakness 128, the first liner portion 134 and the first substrate portion 120 separate from the tag 100, and the first substrate portion 120 form the baggage claim check 127 and the first liner portion 134 form a liner backing of the baggage claim check 127. At block 708, the remaining portions 147 of the tag 100, including the baggage ID tag 129, may be fed through a handle of the baggage and the end 148 of the second substrate portion 122 may be aligned with and coupled to the other end 150 of the tag 100 via the adhesive 104.

Figure 8:
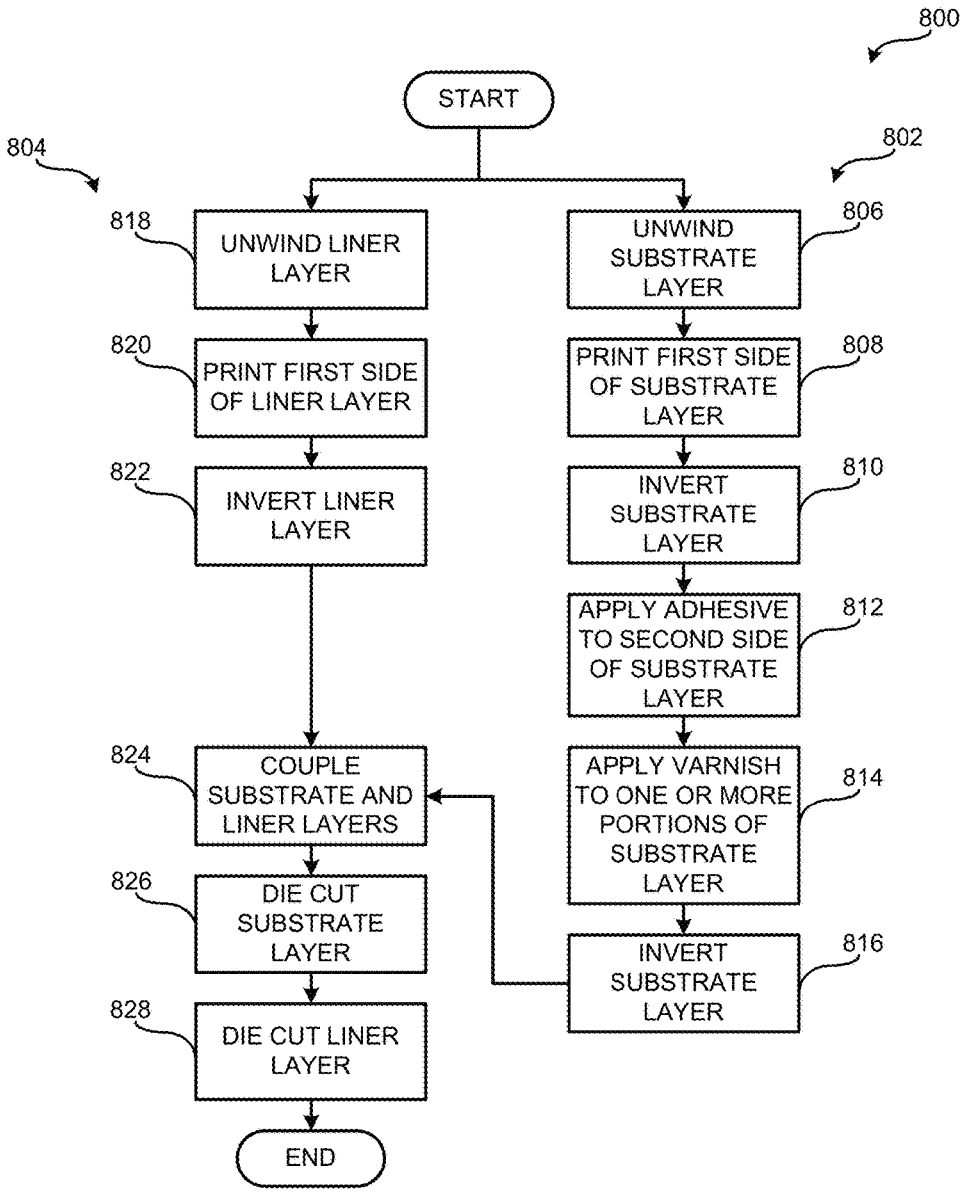
FIG. 8 is an example method of making the examples disclosed herein.

FIG. 8 depicts an example flow diagram representative of a process that may be implemented using, for example, computer readable instructions that may be carried out in conjunction with paper processing equipment such as die cutters, web presses, etc. to produce the example bag tags 100, web 402 or any other of the examples described herein. The example process of FIG. 8 may be performed using a processor, a controller and/or any other suitable processing device. For example, the example process of FIG. 8 may be implemented using coded instructions (e.g., computer readable instructions) stored on a tangible computer readable medium such as a flash memory, a read-only memory (ROM), and/or a random-access memory (RAM). As used herein, the term tangible computer readable medium is expressly defined to include any type of computer readable storage and to exclude propagating signals. Additionally or alternatively, the example process of FIG. 8 may be implemented using coded instructions (e.g., computer readable instructions) stored on a non-transitory computer readable medium such as a flash memory, a read-only memory (ROM), a random-access memory (RAM), a cache, or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

Alternatively, some or all of the example process of FIG. 8 may be implemented using any combination(s) of application specific integrated circuit(s) (ASIC(s)), programmable logic device(s) (PLD(s)), field programmable logic device(s) (FPLD(s)), discrete logic, hardware, firmware, etc. Also, some or all of the example processes of FIG. 8 may be implemented manually or as any combination(s) of any of the foregoing techniques, for example, any combination of firmware, software, discrete logic and/or hardware. Further, although the example process of FIG. 8 is described with reference to the flow diagram of FIG. 8, other methods of implementing the process of FIG. 8 may be employed. For example, the order of execution of the blocks may be changed, and/or some of the blocks described may be changed, eliminated, sub-divided, or combined. Additionally, the example process of FIG. 8 may be performed sequentially and/or in parallel by, for example, separate processing threads, processors, devices, discrete logic, circuits, etc.

FIG. 8 represents an example method 800 of producing an example web such as, for example, the example web 402. At blocks 802 and 804, respectively, substrate layer processes and liner layer processes are performed. The substrate layer processes include blocks 806-816 and liner layer processes includes blocks 818-822. While the substrate layer processes 802 and the liner layer processes 804 are depicted as being performed in parallel, portions or all of the substrate layer processes and liner layer processes may be performed sequentially.

Referring to the substrate layer processes 802, at block 806, the system 400 unwinds the substrate layer 406 from the first unwinder 404 and, at block 808, information is printed on a first side of the substrate layer 406 (blocks 806, 808). The substrate layer 406 is inverted (by, for example, turn bar 410), and an adhesive layer is applied to a second side of the substrate layer 406 (by, for example, the adhesive station 412) (blocks 810, 812). After the adhesive is applied, a varnish or other deadening material is applied to one or more portions of the second side of the substrate layer 406 to deactivate or deaden the corresponding adhesive layer (block 814) by, for example, the varnishing station 414. Thereafter the substrate layer 406 is inverted (by, for example, the turn bar 416) and coupled or mated to another ply (blocks 816 and 824).

Referring to the liner layer processes 804, at block 818, the system 400 unwinds the liner layer 420 from the second unwinder 418 and, at block 820, information is printed on a first side of the liner layer 420 (blocks 818, 820) by, for example, the printer 422. The liner layer 420 is inverted (by, for example, the turn bar 424) and coupled or mated to another ply (blocks 822, 824).

After the substrate layer 406 and the liner layer 420 are treated (e.g., given a layer of adhesive, varnish, release coating and/or printing) and properly oriented, the substrate and liner layers 406, 420 are mated, married or otherwise coupled to form the example web 402 (block 824) using, for example, the press 426. One or more cut(s) are made through one or more portion(s) of the substrate layer 406 from a first or exposed face of the substrate layer 406 (block 826) by, for example, the first cutter 428. One or more cut(s) are made through one or more portions of the liner layer 420 from a second or exposed face of the liner layer 420 (block 828) by, for example, the second cutter 430. In addition, additional cuts are made through the entire web to form a line of weakness and a plurality of baggage ID tags using, for example, the first cutter 428, the second cutter 430 or a third cutter. After the cuts are made, the web 402 is wound or folded for transportation, storage, etc.

An example method of preventing the destruction of a baggage identification tag and claim check combination comprising a liner and a substrate and having a first end and a second end includes providing a first line of weakness extending only through the liner and providing a second line of weakness extending only through the liner, wherein a first portion of the liner between the first line of weakness and the first end forms a first liner backing of a claim check. A second portion of the liner is formed between the first line of weakness and the second line of weakness and a third portion of the liner between the second line of weakness and the second end forms a second liner backing of a baggage identification tag. The example method also includes providing instructions to remove the first portion of the liner by peeling the first portion of the liner from the first line of weakness in a first direction toward the first end and enabling the second portion of the liner to separate from the liner via the second line of weakness when the second portion is peeled from the first line of weakness in a second direction toward the second end.

In some examples, when the second portion is separated from the liner up to the second line of weakness, the third portion is unchanged.

In some examples, the method also includes providing instructions to adhere the second end to the first end when the first portion is removed.

In some examples, the method also includes providing instructions not to separate the second portion from the liner.

In some examples, the method includes adding a permanent adhesive between the second portion of the liner and the substrate.

In some examples, the method includes adding a permanent adhesive between the third portion of the liner and the substrate.

In some examples, the method includes adding an adhesive deadener between the second portion of the liner and the substrate.

In some examples, the method includes adding adhesive between the first portion and the substrate and between the third portion and the substrate but not between the second portion and the substrate.

In some examples, the first line of weakness is separated from the first end by a first distance, the second line of weakness is separated from the first line of weakness by a second distance and the first distance is greater than the second distance.

In some examples, the second line of weakness is separated from the second end by a third distance and the third distance is greater than the first distance.

In some examples, the method includes providing a repositionable adhesive layer between the first portion and the substrate.

In some examples, the method includes providing instructions for self-application of the liner by an airline passenger.

An example label includes a substrate having a first side and a second side and a layer of adhesive coupled to the first side of the substrate. The example label also includes a liner coupled to the adhesive layer over the first side of the substrate, the liner having a first end, a second end, a first side and a second side. The example label includes a first line of weakness extending only through the liner and extending from the first side of the liner to the second side of the liner and a second line of weakness extending only through the liner and extending from the first side of the liner to the second side of the liner, adjacent to the first line of weakness and between the first line of weakness and the second end. A first portion of the liner between the first line of weakness and the first end forms a first liner backing for a baggage claim check. A second portion of the liner is formed between the first line of weakness and the second line of weakness. A third portion of the liner between the second line of weakness and the second end forms a second liner backing for a baggage identification tag. The first line of weakness is separated from the first end by a first distance. The second line of weakness is separated from the first line of weakness by a second distance and the first distance is greater than the second distance.

In some examples, the label includes a permanent adhesive between the second portion of the liner and the substrate.

In some examples, the label includes a permanent adhesive between the third portion of the liner and the substrate.

In some examples, the label includes an adhesive deadener between the second portion of the liner and the substrate.

In some examples, the label includes adhesive between the first portion and the substrate and between the third portion and the substrate but not between the second portion and the substrate.

In some examples, the second line of weakness is parallel to the first line of weakness.

In some examples, the second line of weakness is separated from the second end by a third distance and the third distance is greater than the first distance.

In some examples, the label includes a repositionable adhesive layer between the first portion and the substrate.

In some examples, the substrate comprises a third line of weakness to divide the substrate into a first substrate portion and a second substrate portion. The first substrate portion forms the baggage claim check and the second substrate portion forms the baggage identification tag.

In some examples, the third line of weakness extends only through the substrate.

In some examples, the label the third line of weakness is separated from the first end by a third distance, and the first distance is greater than the third distance.

In some examples, the baggage claim check comprises the first substrate portion having a first length, and the first portion of the liner having a second length, the second length greater than the first length.

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. A method of preventing destruction of a baggage identification tag and claim check combination comprising a liner and a substrate and having a first end and a second end, the method comprising:

providing a first cut extending through the liner and not through the substrate;

providing a second cut extending through the liner and not through the substrate, wherein the first and the second cuts divide the liner into a first portion of the liner between the first cut and the first end, a second portion of the liner between the first cut and the second cut, and a third portion of the liner between the second cut and the second end;

providing a third cut that extends through the substrate and not through the liner to divide the substrate into a first substrate portion and a second substrate portion, wherein the first substrate portion forms the baggage claim check and the second substrate portion forms the baggage identification tag; and providing instructions to remove the first portion of the liner by peeling the first portion of the liner from the first cut in a first direction toward the first end away from the second portion;

wherein peeling the liner from the first cut toward either the first end or the second end leaves the third portion of the liner attached to the second portion of the substrate.

2. The method as defined in claim 1, wherein the second portion of the liner is removable up to the second cut without causing removal of the third portion of the liner.

3. The method as defined in claim 1, further comprising providing instructions to adhere the second end to the first end using adhesive exposed when the first portion of the liner is removed.

4. The method as defined in claim 1, further comprising providing instructions not to remove the second portion of the liner.

5. The method as defined in claim 1, further comprising adding a permanent adhesive between the second portion of the liner and the substrate.

6. The method as defined in claim 1, further comprising adding a permanent adhesive between the third portion of the liner and the substrate.

7. The method as defined in claim 1, further comprising adding an adhesive deadener between the second portion of the liner and the substrate.

8. The method as defined in claim 1, further comprising adding adhesive between the first portion of the liner and the substrate and between the third portion of the liner and the substrate but not between the second portion of the liner and the substrate.

9. The method as defined in claim 1, wherein the first cut is separated from the first end by a first distance, the second cut is separated from the first cut by a second distance and the first distance is greater than the second distance.

10. The method as defined in claim 1, wherein the second cut is separated from the second end by a third distance and the third distance is greater than the first distance.

11. The method as defined in claim 1, further comprising providing a repositionable adhesive layer between the first portion of the liner and the substrate.

12. The method as defined in claim 1, further comprising providing instructions for self-application of the baggage identification tag by an airline passenger.

13. The method as defined in claim 1, further comprising enabling the second portion of the liner to be removed via the second line of weakness when the second portion of the liner is peeled from the first line of weakness in a direction toward the second end.

14. The method as defined in claim 1, wherein the second cut is separated from the first cut by a first distance and separated from the second end by a second distance greater than the first distance.

15. The method as defined in claim 1, wherein the first cut is separated from the first end by a first distance and the second cut is separated from the second end by a second distance greater than the first distance.

16. The method as defined in claim 1, wherein one or more of the second or third portions of the liner is permanently adhered to the substrate.

17. The method as defined in claim 1, wherein the first and second cuts are parallel.

18. The method as defined in claim 1, wherein the third portion of the liner has instructions to attach the first portion.

19. The method as defined in claim 1, further comprising providing a fourth cut that extends through the substrate and not through the liner to define a third substrate portion adjacent the second substrate portion, the fourth cut at a first distance from the second end, wherein the first distance is less than a second distance between the second cut and the second end.

20. The method as defined in claim 19, further comprising providing a fifth cut that extends through the substrate and not through the liner to define a fourth substrate portion adjacent the third substrate portion, the fifth cut at a third distance from the second end, wherein the third distance is less than the first distance.

21. The method as defined in claim 20, wherein the fourth and fifth substrate portions depict information related to first and second trip legs, respectively.

22. The method as defined in claim 1, further comprising providing sensor holes at one or more of the first or second ends.

23. The method as defined in claim 1, wherein the second portion of the liner forms a backing of a portion of the baggage identification tag.

24. The method as defined in claim 1, further comprising providing instructions not to remove the third portion of the liner.

25. The method of claim 1, further including applying a layer of adhesive to the substrate, wherein the layer of adhesive secures the liner to the substrate and is continuous between the first end and the second end.

26. A label comprising:

a substrate having a first side and a second side;

a layer of adhesive coupled to the first side of the substrate;

a liner coupled to the adhesive layer over the first side of the substrate, the liner having a first end, a second end, a first edge, and a second edge;

a first cut extending through the liner and not through the substrate and extending from the first edge of the liner to the second edge of the liner; and a second cut extending through the liner and not through the substrate and extending from the first edge of the liner to the second edge of the liner, the second cut adjacent to the first cut and between the first cut and the second end;

a third cut that extends through the substrate and not through the liner to divide the substrate into a first substrate portion and a second substrate portion, wherein the first cut and the second cut divide the liner into a first portion of the liner between the first cut and the first end, a second portion of the liner is formed between the first cut and the second cut, and a third portion of the liner between the second cut and the second end, wherein the first substrate portion forms the baggage claim check and the second substrate portion forms the baggage identification tag, wherein the first cut is separated from the first end by a first distance, the second cut is separated from the first cut by a second distance, and second end is separated from the second cut by a third distance, and the first distance and the third distance are greater than the second distance; and wherein peeling the liner from the first cut toward either the first end or the second end leaves the third portion of the liner attached to the second portion of the substrate.

27. The label as defined in claim 26, further comprising a permanent adhesive between the second portion of the liner and the substrate.

28. The label as defined in claim 26, further comprising a permanent adhesive between the third portion of the liner and the substrate.

29. The label as defined in claim 26, further comprising an adhesive deadener between the second portion of the liner and the substrate.

30. The label as defined in claim 26, further comprising adhesive between the first portion of the liner and the substrate and between the third portion of the liner and the substrate but not between the second portion of the liner and the substrate.

31. The label as defined in claim 26, wherein the second cut is parallel to the first cut.

32. The label as defined in claim 26, wherein the second cut is separated from the second end by a third distance and the third distance is greater than the first distance.

33. The label as defined in claim 26, further comprising a repositionable adhesive layer between the first portion of the liner and the substrate.

34. The label as defined in claim 26, wherein the third cut is separated from the first end by a third distance, and the first distance is greater than the third distance.

35. The label as defined in claim 34, wherein the baggage claim check comprises the first substrate portion having a first length, and the first portion of the liner having a second length, the second length greater than the first length.

36. The label as defined in claim 26, wherein the baggage claim check has a length different than the first distance.

37. The label as defined in claim 26, wherein the baggage identification tag has a different length than the second distance.

38. The label as defined in claim 26, wherein the third cut is separated from the first end by a third distance, the third distance less than the first distance.

39. The label of claim 26, wherein the layer of adhesive is continuous between the first end and the second end of the substrate.

* * * * *